US005919334A

United States Patent [19]

Niedermeyer

[11] Patent Number: 5,919,334

[45] Date of Patent: Jul. 6, 1999

[54] METHOD AND APPARATUS FOR FABRICATION AND ASSEMBLY OF APPAREL

[76] Inventor: William P. Niedermeyer, 1024 Mt. Mary Dr., Green Bay, Wis. 54311

[21] Appl. No.: 08/796,438

[22] Filed: Feb. 10, 1997

Related U.S. Application Data

[63] Continuation-in-part of application No. 08/598,368, Feb. 8, 1996, Pat. No. 5,795,433.

[51] Int. Cl.[6] ..... A41D 1/00; A41H 33/00; D05B 35/00

[52] U.S. Cl. ..... 156/479; 156/226; 156/227; 156/517; 156/520

[58] Field of Search ..... 156/475, 477.1, 156/479, 517, 520, 521, 212, 226, 227

[56] References Cited

U.S. PATENT DOCUMENTS

| | | |
|---|---|---|
| 3,689,061 | 9/1972 | Nystrand . |
| 3,823,935 | 7/1974 | Guichard . |
| 3,870,292 | 3/1975 | Bradley . |
| 4,003,775 | 1/1977 | Batt . |
| 4,055,859 | 11/1977 | Green . |
| 4,160,423 | 7/1979 | Scholl . |
| 4,266,112 | 5/1981 | Niedermeyer . |
| 4,289,493 | 9/1981 | Hedrich . |
| 4,316,756 | 2/1982 | Wilson . |
| 4,328,655 | 5/1982 | Spencer . |
| 4,347,955 | 9/1982 | Kamal . |
| 4,425,173 | 1/1984 | Frick . |
| 4,448,626 | 5/1984 | Off . |
| 4,549,916 | 10/1985 | Off . |
| 4,699,302 | 10/1987 | Papajewski . |
| 5,211,320 | 5/1993 | Hubele . |
| 5,795,433 | 8/1998 | Niedermeyer ..... 156/479 |

*Primary Examiner*—Daniel Stemmer

[57] ABSTRACT

The machine of the present invention is used to produce articles of apparel having an openable front or rear panel. It includes feeder mechanisms to supply two half width webs and webs for reinforced edges through cutter mechanisms where webs cut into segments for the desired garment are overlapped to provide a central opening. Segments are transferred to a carrier drum having folding devices which are operative while the drum rotates. A full width web with a pattern of adhesive pre-applied to selected margins is overlaid on top. The underlying segments have extension flaps along selected margins which are folded around and over the edges of the top panel segment and bondably seamed to it by means on, or co-acting with, the carrier drum. Seams can be made along transverse, longitudinal, or skewed lines by different folding device arrangements. In another embodiment, an openable front or rear panel can be produced by including a transverse vacuum folding roll to half fold overlapped segments into a front/rear panel configuration and means to then fold extensions on each rear half panel over the transversely folded front half portions positioned away from the drum surface. Machine arrangements can include special devices for features like pockets, shoulder pieces, shirt collars, etc.

19 Claims, 8 Drawing Sheets

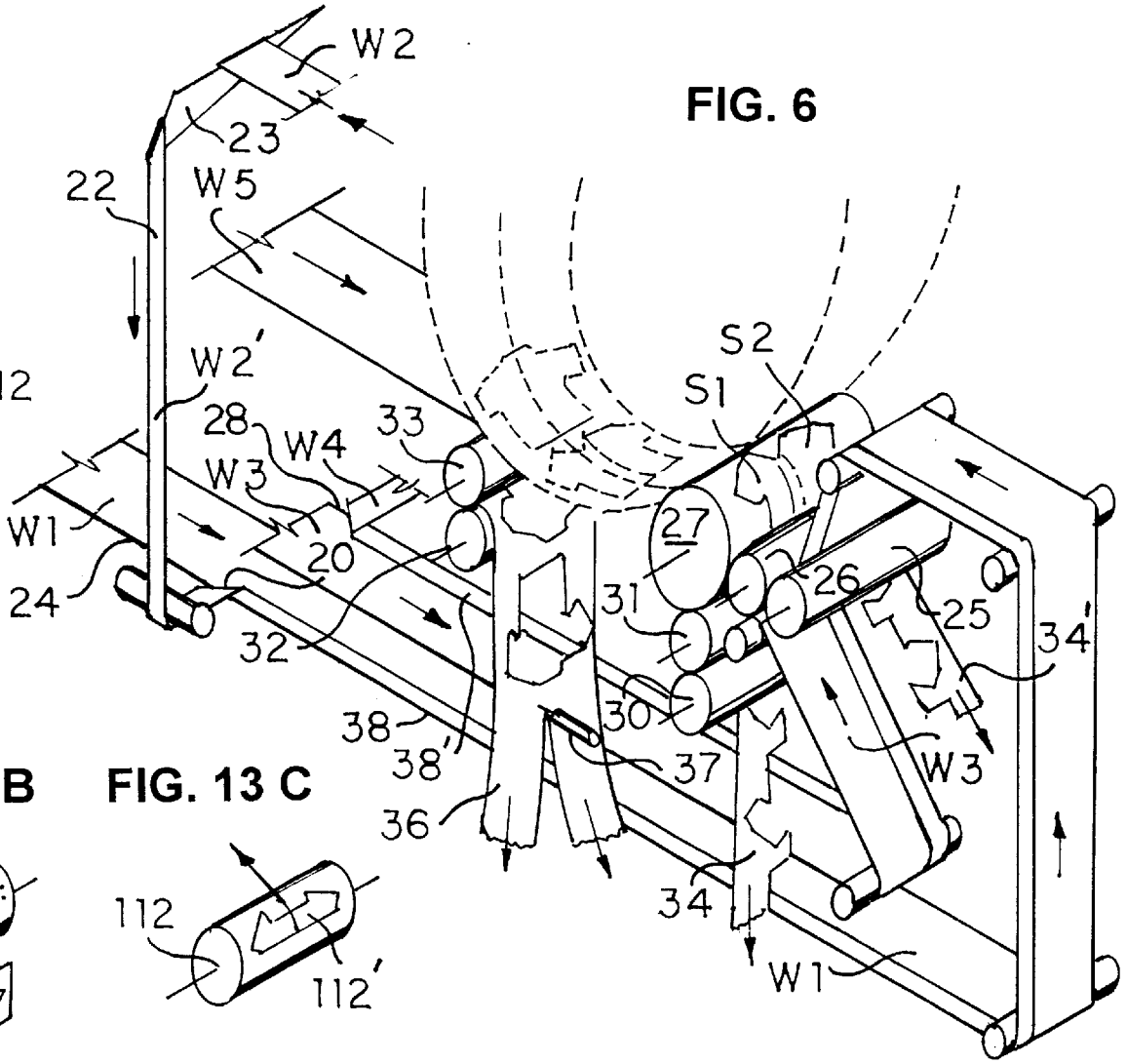
FIG. 6
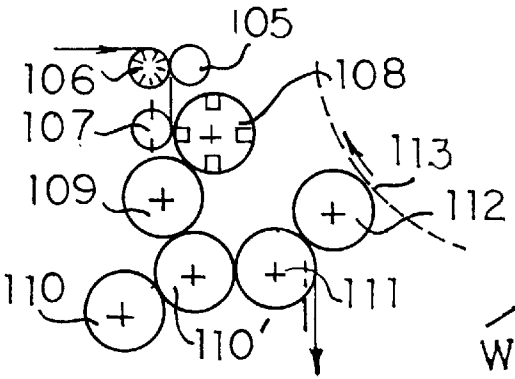
FIG. 13
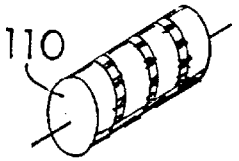
FIG. 13 A
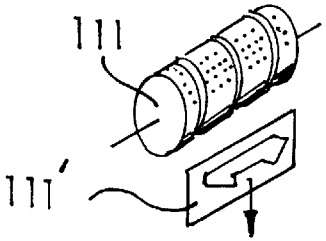
FIG. 13 B
FIG. 13 C FIG. 11
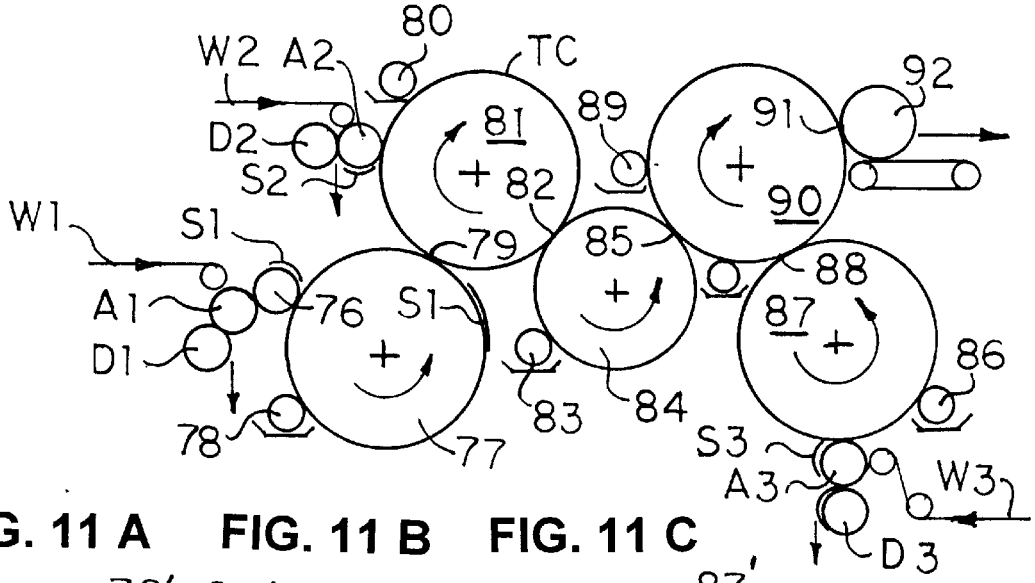
FIG. 11 A
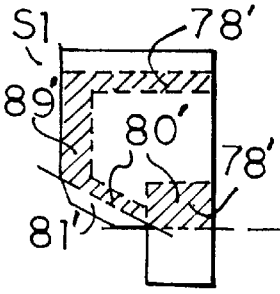
FIG. 11 B
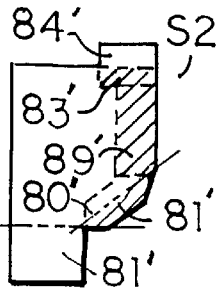
FIG. 11 C
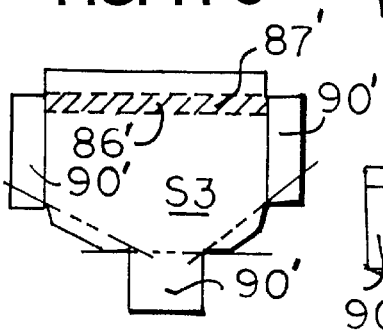
FIG. 11 D
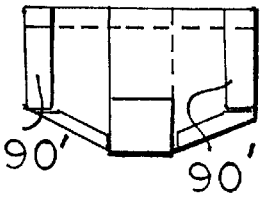
FIG. 16
FIG. 15
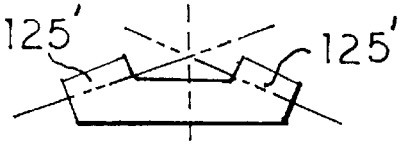
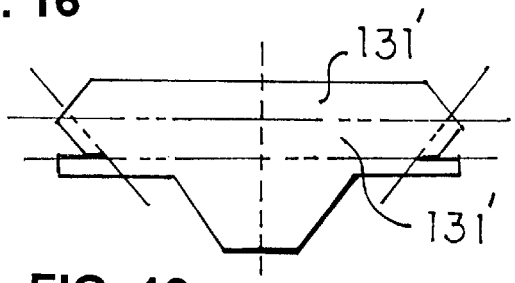
FIG. 18
FIG. 17
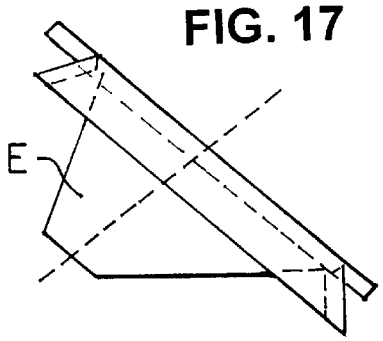
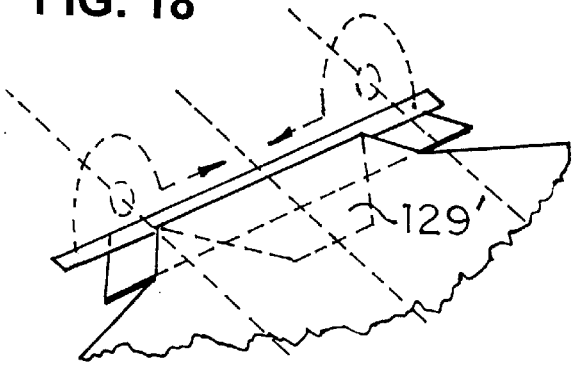

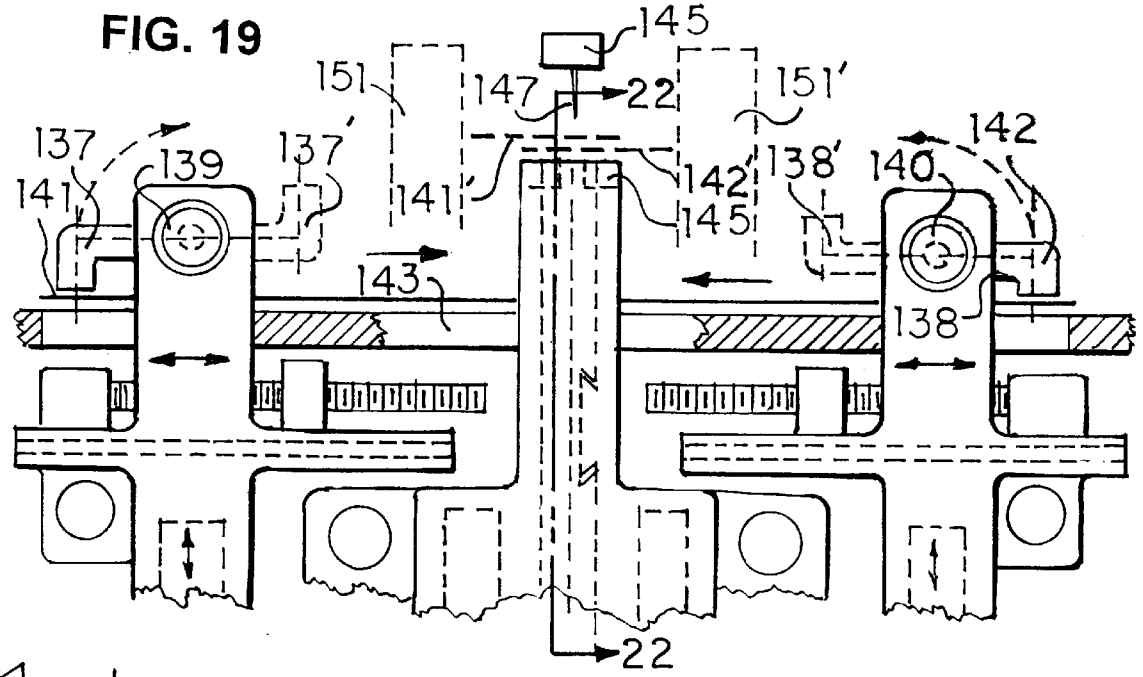
FIG. 19
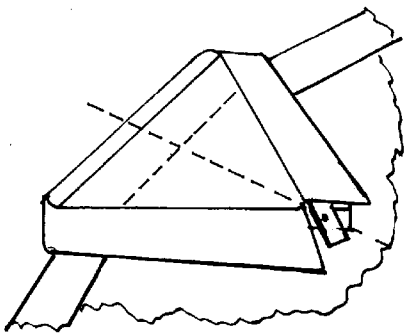
FIG. 23
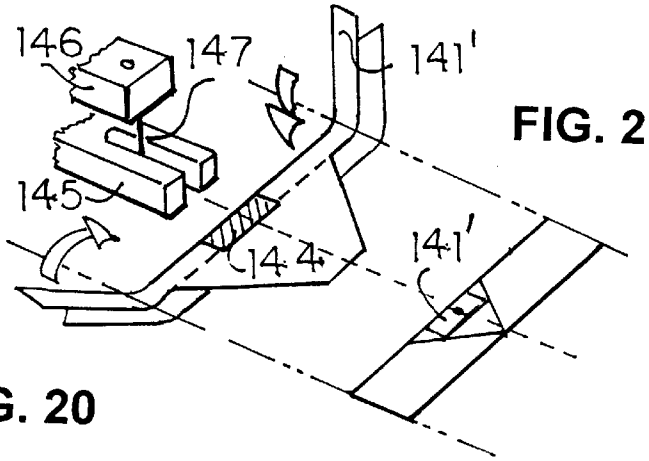
FIG. 21
FIG. 20

METHOD AND APPARATUS FOR FABRICATION AND ASSEMBLY OF APPAREL

This is a continuation-in-part of U.S. patent application Ser. No. 08/598,368 filed Feb. 8, 1990, now U.S. Pat. No. 5,795,433 which teaches the use of folding/seaming drum apparatus for joining two or more panel segments along selected margins to produce the basic front/rear structure of apparel articles, and machine arrangements that produce an openable front panel so that garments can be put on then closed for wear.

SUMMARY AND BACKGROUND

Well known closures like 'zipper' strips or segments are attached to the inside of panel openings, or closures like tapes can added to the outsides of the openings.

Specifically this invention covers means to create the openable/closeable product feature by overlapping the central portions of webs before segments are die cut, or by advancing two half width webs through die cutters to form similarly but oppositely shaped segments before transferring them in overlapped superposed relationship to a folding drum.

Apparatus and devices are also described to enclose selected edges of slit webs between a V-folded strip that reinforces each cut segment along edges that become part of the garment opening.

After the reinforcing strip is attached to each of the half width web edges before die cutting into shaped segments, the reinforced segments are transferred to one or more folding drums for bonded seaming and assembly.

This invention describes machine arrangements, each unique for each different product, and includes devices used to add shoulder reinforcement pieces, pockets, and collars subsequently folded into a triangular orientation, as on textile shirts.

FIGS. 1–4 illustrate how the folding/seaming apparatus of the parent teaching works and the types of seams it can produce.

FIGS. 5 and 6 illustrate new elements and an arrangement for making openable front or rear panels for garments, including devices for adding the reinforcing strips to edges to overlapped panels FIGS. 7–23 illustrate devices to make the openable feature and different machine arrangements for different products.

Each machine illustration also reefers to product sketches so that product assembly sequence is cross referenced to the machine elements that perform the fabricating steps.

In certain arrangements, a transverse vacuum folding roll, well known in the art, is used to fold the segments in half lengthwise prior to the folding/seaming procedures that form the basic panel to panel structure.

The machines described herein each start with supply rolls of web material and end with packaged finished product, however for brevity, the final folding and well known packaging steps are omitted from the descriptions.

It is also noted that descriptions of the devices for creating a strip reinforced garment opening per FIGS. 5 and 6, are not repeated for each machine arrangement for brevity and clarity of illustration.

To maintain high speed efficiencies, apparatus well known to artisans are not described in detail but would be used, for example, flying splice unwind stands, trim eliminators for scrap, tape applicating devices, adhesive printing means, orbital blade folders, panel folding conveyors, etc.

Other advantages and objects of the invention may be seen in the ensuing specification.

BRIEF DESCRIPTION OF DRAWINGS

FIG. 6 is a perspective view illustrating offset web and strip feed arrangements required to make the 'soft edges', remove scrap material after die cutting, and transfer segments.

FIG. 11 is a side elevation schematic of the apparatus for producing the shorts/undershorts in FIGS. 11A to 11D.

FIG. 11A is a plan view of the left half width segment of the shorts in FIG. 11D.

FIG. 11B is a plan view of the right half width segment of the shorts in FIG. 11D.

FIG. 11C is a plan view of the rear full width segment of the shorts in FIG. 11D.

FIG. 11D is a front plan view illustrating the assembled components of the shorts.

FIG. 13 is a schematic side elevation of the apparatus sub-assembly for advancing and processing a web segment having a length less that the product length, for example, pockets, collars, etc.

FIG. 13A is a perspective view of a die roll used in the segment transfer apparatus shown in FIG. 13.

FIG. 13B is a perspective view illustrating grooves of a stripper roll used in the apparatus of FIG. 13.

FIG. 13C is a perspective view of a vacuum roll used to transfer a die cut piece to a carrier drum surface.

FIG. 15 is a plan view of a shoulder piece component of the shirt in FIG. 14A.

FIG. 16 is a plan view of an unfolded collar of the shirt in FIG. 14A.

FIG. 17 is a perspective plan view of the collar after completing a double transverse fold.

FIG. 18 is a perspective plan view of the opposite side of the collar as oriented for attachment to the rear panel of a shirt.

FIG. 19 is an end view elevation of a collar "C" folding device viewed in the direction of 19—19 of FIG. 14.

FIG. 20 is a perspective view of the double cross folded collar being rotated into a C-folded configuration like FIG. 21 and translated to overlap the tab ends for subsequent translation and triangular folding.

FIG. 21 is a perspective view of a collar after completion of the tab end overlap and controlled capture, but before completion of the triangular fold.

FIG. 23 is a perspective view of a shirt collar after the triangular fold is completed.

DETAILED DESCRIPTION

Figure 1:
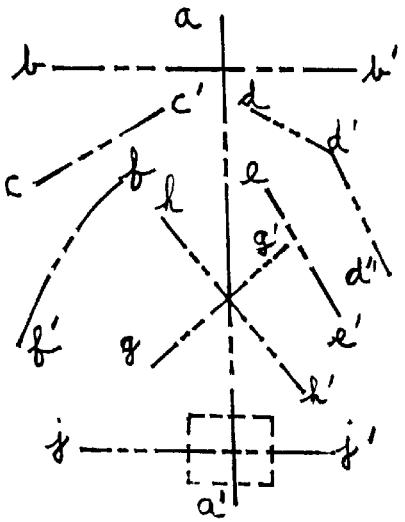
FIG. 1 is a diagrammatic orientation of fold lines about which the folding/seaming apparatus of FIG. 2 makes folds.

FIG. 1 illustrates fold lines about which a folding/seaming drum of the parent invention can complete seams.Fold line a–a' and parallel lines (not shown) are in the machine direction and are also referred to as longitudinal or M.D. fold lines.

Folding along line b–b' create seams along transverse, C.D., or cross direction lines.

In the product drawings related to each machine, other lines like c–c' are at an angle to the cross direction, line e–e' at angles to machine direction, etc. Folds along line d–d'–d" would commonly be used to make seams along shoulders and sleeves.

Certain arrangements herein define apparatus used to complete all seams on a single drum, and others use two or more folding/seaming drums, each with a plurality of bearing surfaces around its circumference.

Figure 7:
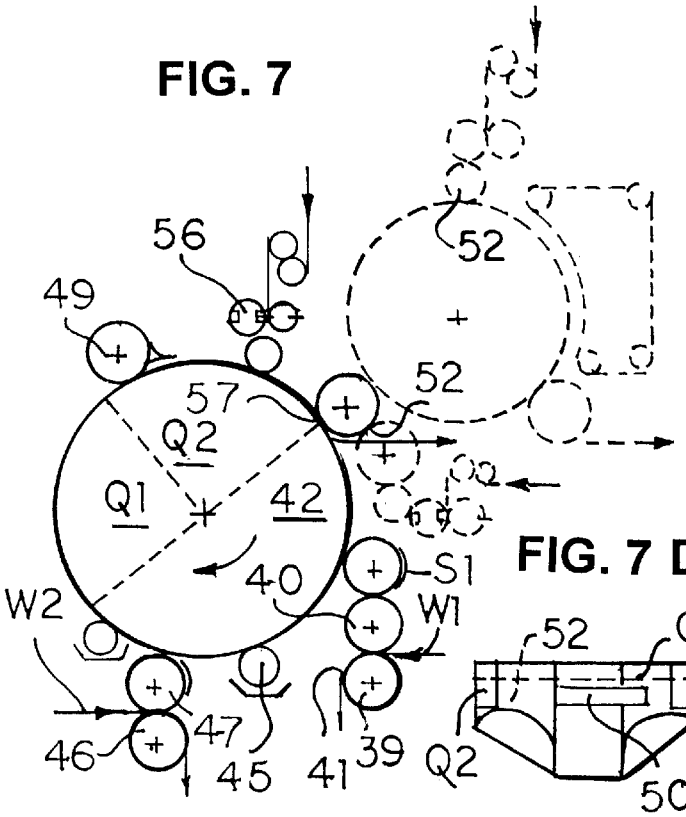
FIG. 7 is a side elevation schematic of the apparatus for producing briefs illustrated in component drawings of FIGS. 7A to 7D.

Line j–j' describes a transverse fold line to fold a product segment in half. In the apparatus of FIG. 7, this half fold produces front and rear panels of the undergarment briefs.

In other products where the panel to panel combination is already completed, the apparatus for transverse folding along j–j' is used to reduce length of the finished product before final packaging.

Figure 2:
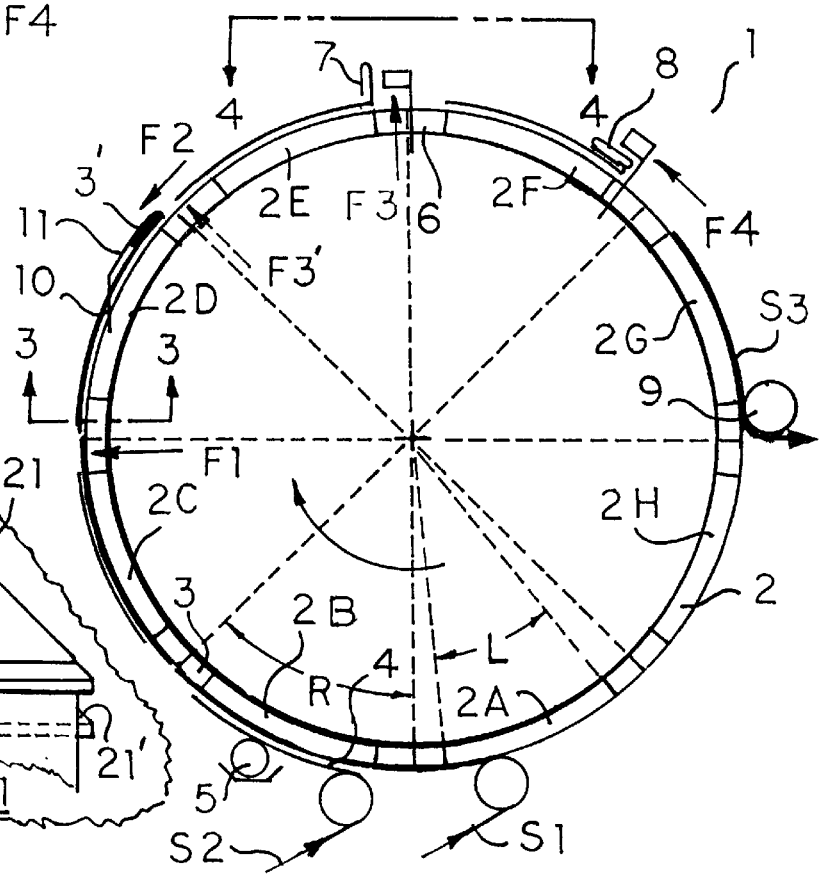
FIG. 2 is a side elevation schematic of the folding/seaming apparatus illustrating the bearing surfaces for segments and progression of single and/or double transverse folds as the drum rotates.

In FIG. 2, the folding/seaming drum 1 has segment bearing surfaces equally spaced around the circumference. The number of bearing surfaces is a function of product length L, spacing between bearing surfaces for folding devices if required, spacing R between products, and the time required for completion of folds during drum rotation before folding fingers must be moved below the surface to clear other coacting rolls. etc.

The drum of FIG. 2 is shown with eight bearing surfaces 2A through 2H spaced at repeat distance R.

Figure 4:
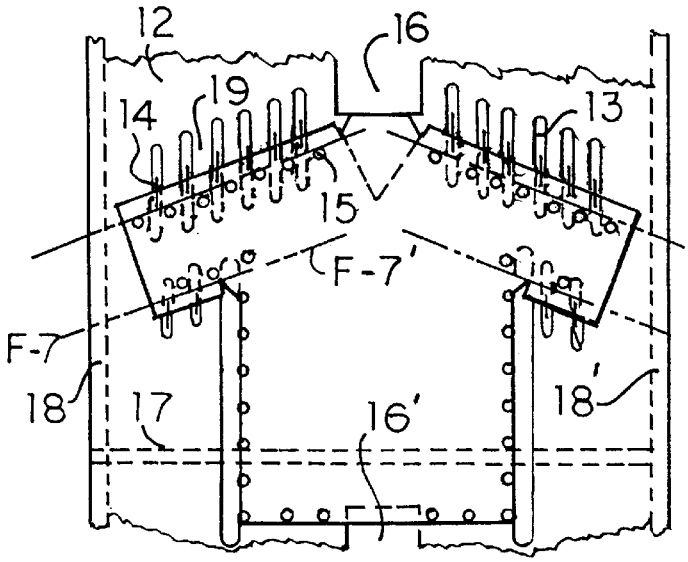
FIG. 4 is a plan view from line 4—4 of FIG. 2 illustrating a bearing surface arranged with slots to cooperate with folding finger mounted along a skewed fold line.

Bearing surfaces are shaped substantially like the outline of the finished product after extended flaps are folded, and have vacuum ports inside of, and in close proximity to, the product outline (see 15 FIG. 4).

In pre-selected locations, the line of vacuum ports define, and are coincident with, fold lines about which marginal extensions of underlying segments are folded over superposed segments to form seams.

In FIG. 2, a first web is cut into shaped segments S1 having a length R equal to the product plus the amount of extended flap, is transferred to bearing surface 2A and held against the drum by vacuum ports connected to a vacuum source (not shown).

The first segment of previous material S1 is placed with extensions 3 of the leading margin over cutouts or slots between bearing surfaces (see also 10 of FIG. 4).The drum rotates, and at position 4, a second smaller web segment S2 having a length is superposed on S1. When S2 passes roll 5, an adhesive pattern is printed along selected margins of S2.

At position 2*c*, a first force F1 is applied radially outward to urge the extension 3 outward, and at position 2*d* a second force F2 completes the fold. Several urging means including air blast can be used to apply force F1 or F2, however movable 'P' shaped fingers are shown in positions 2*d* etc.

In position 2*c*, a plurality of fingers 6 (see position 2*e*) urge extension 3' outward, and in position 2*d* the same plurality of fingers is moved in a direction opposite to M.D. to complete the first cross fold.

Before the bearing surface reaches position 2*e*, a movable sub frame (not shown) with the fingers mounted thereon would be positioned under the completed fold, as at F3' in position 2*d* (shown in phantom) and during rotation to position 2*e*, applies an upward force F3, and at position 2*f*, a second force F4 to complete the double transverse fold 8.

The conjoined segment assembly S3 can be advanced from exit position 9 to downstream processing or packaging.

Figure 3:
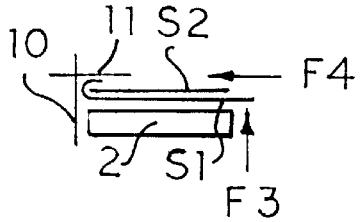
FIG. 3 is viewed in the direction of 3—3 of FIG. 2 and illustrates means used to generate longitudinal M.D. folding of bottom segment extensions over superposed segments.

FIG. 3 illustrates devices to complete longitudinal folds. An inclined rod 10 applies a first force F3 to an extension of the underlying segment S1. The extension is urged radially outward from the surface of drum 2 (FIG. 2). A second rod 11 folds the extension parallel to the drum surface to complete the seam. By mounting rods 10 and 11 or air blasts tubes (not shown) on an external framework that moves transversely while the drum rotates, sloped seams along lines e–e' and f–f' of FIG. 1 are produced.

FIG. 4 shows a portion of a drum bearing surface 12 with cutouts 13 to accommodate a plurality of fingers 14 (see also 6 of FIG. 1) arranged along skewed fold lines F7–F7'. The fingers are mounted in at least two sub frames (not shown for clarity), one of which moves vertically and the second frame moves forward and reverse in the machine direction.

Before the folding cycle begins, fingers 14 are positioned ahead of the fold line underneath the extended portion of a first segment S1 being held against the drum surface by vacuum ports 15, also aligned along, and in close proximity to, fold lines F7–F7'

Referring again to FIG. 2, means are included (not shown) to move one sub frame vertically outward and cause fingers 6 (of FIG. 2) or other means to urge the extended portion 3 of a first segment S1 radially outward before the other subframe moves in the machine direction to fold extended flaps over edges of segment S2, thus completing the fold It is noted that the location and direction of fold lines and the cooperating placement of vacuumized ports in close proximity to the fold lines substantially defines the shape of the segment S2 which is subsequence enclosed by the overlapped flaps of segment S1 to create a seam along selected margins of the product.

In FIG. 4, cut outs 13 in drum surface 12 extend in the machine direction to allow vertical and horizontal movement (parallel to the drum surface) of fingers. The embodiment shown is particularly advantageous for components positioned outside the outline of the panel (see collar placement in FIG. 18), since they can be supported by land areas 19 between slots 13.

In the illustration of FIG. 4 for shirts with collars, a large cutout 16 of the drum surface allows for movement of special collar folding devices (see FIGS. 18–22).

For some products, the drum 2 has bearing areas of drum surfaces 12 defined by areas within vacuum ports positioned along margins of the product outline.

Platens shaped substantially like the product, and requiring removal of drum material outside the bearing surfaces as defined above, can be used and would be supported by cross members 17 attached to side frames 18 in FIG. 4.

Figure 5:
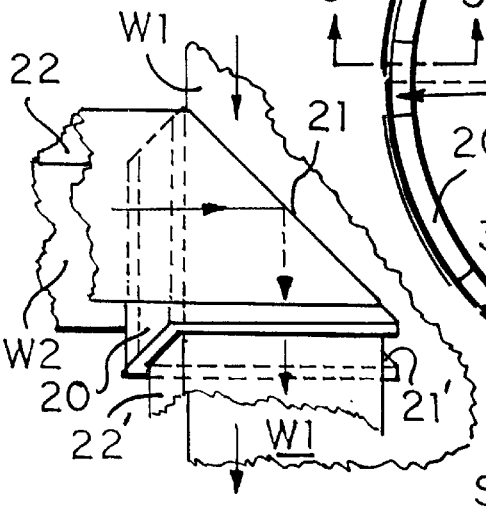
FIG. 5 is a perspective view illustrating a special 'inverse' double folding plate device used to reverse fold a V-folded strip to enclose cut edges of a web or segment.

FIG. 5 illustrates the 'inverse' V-folding plate pair 20 that receive V-folded incoming web W2 on the outer surface of each plate, and by advancing the web over folding edges 21 and 21', changes web direction 90 degrees and reverses the v-fold so its apex is at 22' and it exits the plate pair in contact with the inner surfaces thereof.

The gap between plates is substantially equal to incoming web portion 22 and as shown includes spacing adequate for clearance of splicing tape, etc., at the end of one supply roll and start of another.

The plate assembly can include devices (not shown) that are adjustable while running and means to pivot the folding plate out of the web path can be included to deactivate the reinforcing strip system but still retain the openable panel feature.

Manufacturing machines for garments with front or rear openable panel construction including briefs, bibs, gowns, vests, shorts/trunks, and pants are described in FIGS. 7–12 respectively.

To produce shirts which require other components like shoulder reinforcement, collars, pockets, etc., machine components to advance a web, cut a rectangular segment, (see FIG. 13) die cut shaped pieces from the segment, and separate the workpiece from the scrap material (see FIG. 6) are included in apparatus combinations described later.

On the left side of FIG. 6, a narrow web W2 of reinforcing material is advanced from a supply roll (not shown) to pass over V-folding plate 23. Apex edge 22 is advanced to enter the folding plate pair 20 (FIG. 5), and after being reverse folded, web W2 exits plate pair 20 to advance in the machine direction.

While web W2 is folded and advanced, a previous web W1 having a width equal to half the product plus a few inches is concurrently advanced and directed between plate pair 20, as at position 24 of FIG. 6.

Printers at positions 24 and 28 for strip printing on both sides of webs W1 and W3, and the web feed system for web W4 are eliminated from the drawing, for clarity noting that these devices are on the opposite sides of the machine.

In FIG. 6, adhesive applied at position 24 to top and bottom margins along one edge of web W1 to subsequently bond the reinforcing strip into a web assembly that is directed to, and cut by, die roll 25 and anvil roll 26 for advancement by vacuum transfer roll 27. Web W1 is offset transversely in the supply roll stand (means not shown) so that one edge is aligned about 2" off center.

A second half width previous web W3 is likewise shifted off center and advanced from an unwind stand (not shown). Web W3 is printed with adhesive on top and bottom margins as at position 28 before being advanced into the folding plate pair 29 (not shown) and conjoined with strip web W4.

The conjoined bonded web with reinforcing strip is advanced to the nip between die roll 30 and anvil roll 31 where it is cut into segment S2, then advanced to vacuum roll 27 where it is partially overlapped and superposed on segment S1.

Concurrently, a third full width web W5 is advanced, cut to shape between die roll 32 and anvil roll 33, advanced to the vacuumized bearing surface of drum 1, and superposed over previously placed segments.

Scrap material from each half web can be handled as trim pieces. The scrap 35 from full web W5 must first be cut into two streamers 36 and 36' by a water jet cutter 37 before being transported as separate trim streamers.

It is noted that top and bottom adhesive patterns for the strip will be intermittent to avoid raised cutting edges on the die roll.

In FIG. 6, closure strips or segments are added between segments (means not shown) before die cutting, as at position 38 and 38'. Die rolls can be relieved in register with closure pieces if necessary.

Figure 8A:
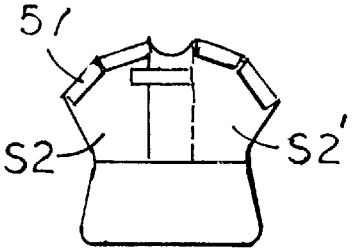
FIG. 8A is a rear plan view of a bib illustrating the left and right hand half width segments forming an opening and connected by closure tape.
Figure 8B:
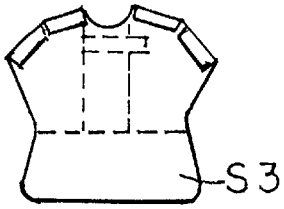
FIG. 8B is a plan view of a bib having a full width, full length front panel.
Figure 8:
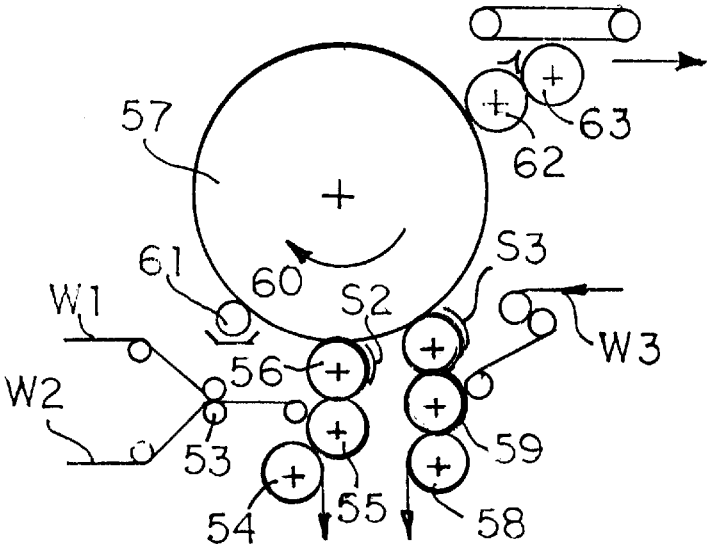
FIG. 8 is a side elevation schematic of apparatus for producing bibs illustrated in FIGS. 8A and 8B.

FIG. 7 defines apparatus used to make briefs with openable panel features from two overlapped shaped segments, and FIG. 8 shows arrangements that combine and overlap two half width webs before die cutting to yield superposed segments (panels) with the opening feature. The apparatus of FIGS. 7 and 8 are described below.

For each machine,devices used to achieve certain fabrication steps are cross referenced to the associated product drawings, with reference prime marks (') added to product feature to show product assembly sequence and location of the machine component that creates the product feature.

In each machine line, the apparatus functions of FIG. 6 are a necessary first step that occurs before overlapped segments are placed on one or more subsequent folding/seaming drums like the drum of FIG.2.

As an integral part of each machine, the description of FIG. 6 apparatus will not be repeated hereinafter, it being understood that webs processed by apparatus of FIG. 6 will have the openable panel feature, and can have selected edges strip reinforced. Hereinafter, folding/seaming drums used for each product are given separate reference numbers to relate the folding functions for the product.

In FIG. 7, a first web W1 slightly wider than one half product width and reinforced along one margin is advanced through the nip between die roll 39 and anvil roll 40. Scrap material is rejected as at 41, and a first segment S1 like the shape of FIG. 7A is transferred to the bearing surface of folding/seaming drum 42 having cutouts like 16 of FIG. 4 ahead of fold line 43–43' (see FIG. 7C) and trailing fold line 44–44'.

Figure 7A:
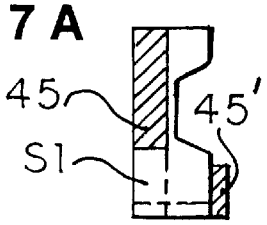
FIG. 7A is a plan view of a half width segment that is the right hand portion of the front panel.
Figure 7B:
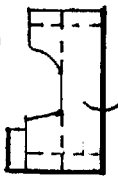
FIG. 7B is a plan view of a half width segment that is the left hand portion of the front panel.

Printer 45 applies adhesive patterns shown crosshatched in FIG. 7A. After a second web W2 passes through die roll 46 and anvil roll 47, a second segment S2 shaped like FIG. 7B is superposed on segment S1, overlapped in the central region as shown in FIG. 7C. When the overlapped segments pass printer 48, adhesive is applied proximate to leading and trailing waistband extensions and the remaining unprinted side flap extensions of S2.

Figure 7D:
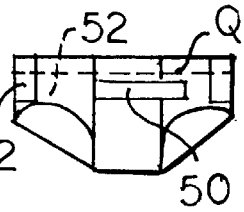
FIG. 7D is a plan view of the completed product illustrating the folded side flaps and the front closure tape.
Figure 7C:
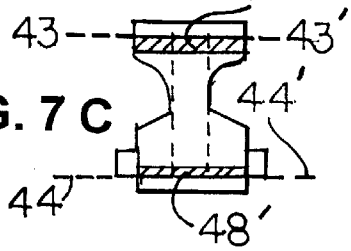
FIG. 7C is a plan view of the right and left hand segments of FIGS. 7A and 7B in superposed and partially overlapped relationship.

Once on the surface of drum 42, waistband extensions are folded in quadrant Q1and, after the front/rear panel are created by folding at transverse vacuum folding roll 49, side flap extensions are folded in quadrant Q2 with M.D. folding rods (see 10 and 11 of FIG. 2) to complete the product of FIG. 7D. Tape closures 50 are added before the product exits at position 51 for subsequent folding and packaging.

A second folding/seaming drum is shown in phantom lines for the purpose of making side folds as a separate function to increase speed, or to add shrinkable strip material parallel to the waistband on the outside of the rear panel, as at position 52.

FIG. 8 shows the overlapped half length webs W1 and W2 being superposed (and overlapped in the central region), as at 53. For the subject bibs, the cut central margins are at the rear so the 'soft edge' strip is not needed, thus, the double plate pair 20 of FIG. 5 is not used. Both half length, half width segments are die cut at the same time between die roll set 55, 56 and advanced to drum 57 before half length segments S1, S2 are combined as at 60. Print roll 61 applies an adhesive pattern to target areas under the extension flaps which are subsequently folded on drum 57. Means for adding closure tapes are not shown.

It is noted that for an openable/closeable panel, web shifting devices on the unwind stands (not shown) are used to overlap half width segments (each equal to half the product width plus about 2") and referred to as half panels hereinafter.

The completed product exits the folding/seaming drum 57 and is transversely folded by roll set 62–63 to reduce its length before transport to subsequent packaging operations.

Figure 9:
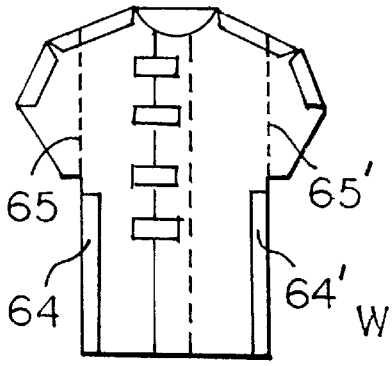
FIG. 9 illustrates a gown that is produced by the machine arrangement similar to FIG. 8.

Apparatus for producing the product of FIG. 9 will be arranged like FIG. 8 without devices for reinforced edge strips. Aside from having a longer repeat (R of FIG. 2), the apparatus for product of FIG. 9 would have longitudinal folding rods 10 and 11 (FIG. 2) means to complete the M.D. folds 64–64' of FIG. 9, and include devices to engage or disengage them by pivoting them above the product when M.D. fold lines cross portions of a panel, as at phantom lines 65 and 65' of FIG. 9 .

Figure 10:
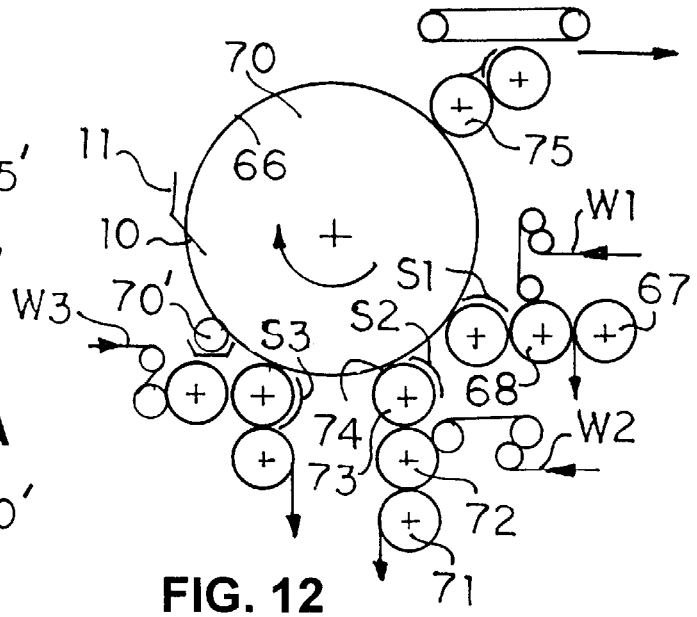
FIG. 10 is a side elevation schematic illustrating the apparatus for producing the vest of FIG. 10A.
Figure 10A:
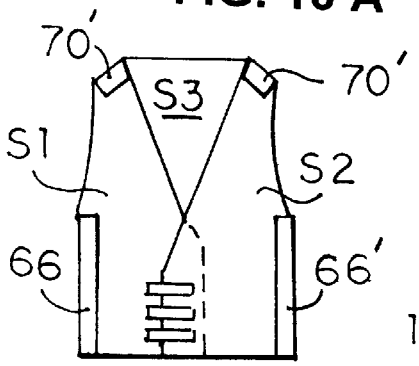
FIG. 10A is a front plan view of a vest with an openable front panel as made on the apparatus of FIG. 10.

To produce the product of FIG. 10A, a half web W1 passes through the nip between die roll 67 and anvil roll 68 to produce a shaped half panel S1, transferred by roll 69 to drum 70. Concurrently, web W2 passes through die cutting rolls 71, 72 and segment S2 is transferred via roll 73 to drum 70 in superposed, centrally overlapped relationship to S1 at position 74.

Likewise, Web W3 is processed to produce full width segment S3 that is placed on top of the overlapped pieces S1 and S2. Segment S3 is then printed along selected shoulder and side margins as at position 70' of FIG. 10 for subsequent seaming. The completed product is folded in half at 75 for downstream packaging.

FIG. 11 illustrates the apparatus combination that is used to produce shorts shown in FIG. 11D, and uses a coacting series of five seaming drums and associated die cutting roll sets to shape two half width panels and a full width rear panel which have the v-folded reinforcing strip described earlier.

In FIG. 11, a first 'left hand' web W1 passes through roll set D1 A1 to produce segment S1 of FIG. 11A which is transferred via roll 76 to drum 77. Segment S1 is adhesively printed at (FIG. 11) in target areas 78' for receiving the folded waistband and crotch flap extensions.

While advancing from printer position 78 to transfer position 79, the waistband and central flap are folded outwardly and bonded to the printed target areas. At transfer position 79, segment S1 will be advanced until segment S2 is superposed in overlapping relationship. Right hand segment S2 of FIG. 11B is generated from web W2 as it passes through roll set D2, A2.

The two superposed segments advance to printer 80 which applies adhesive to target areas on both half width panels, as at 80' for subsequent bonding of folded leg flaps on both half panels. In FIG. 11 print roll 80 also prints adhesive 80' (FIG. 11A and 11B) on the outer surface of segment S1 in the crotch area in readiness to receive the central flap from the right hand segment S2 which is folded and superposed on area 80' in the crotch area (see FIG. 11A).

Directly thereafter, well known apparatus for adding a tape closure (referenced as T.C.) is shown coacting with drum 81. As drum 81 rotates between printer 80 and transfer point 82, the leg folds and central flap fold joining the two half panels are completed. At print roll 83, an adhesive pattern is applied to the top right portion of segment S2 and while rotating toward transfer point 85, the top (partial width) waistband flap 84' is folded and bonded to target area 83'.

On the lower right side of FIG. 11, a third web W3 passes between die cutting set D3, A3 and segment S3 is transferred to folding drum 87.

At print roll 86, a printed pattern of adhesive 86' (see FIG. 11 C) defines the target area for the waistband which is then folded by devices of drum 87 as it rotates from printer 86 to transfer point 88. Segment S3 is superposed against the surface of drum 90. Overlapped segments S1 and S2 are also transferred to drum 90 and superposed on segment S3 of FIG. 11C.

As the outwardly facing overlapped segments S1 and S2 pass printer 89, adhesive target area 89' is printed on side margins of the two half with panels (FIG. 11A, 11B) and on the already folded central crotch flap of S2 which faces the printer roll. As drum 90 rotates from printer 89 toward exit transfer position 91, fingers like 6 of FIG. 2 complete the crossfold of the extended flap 90' (FIG. 11C), and a longitudinal folder with rods 10 and 11 complete the side folds 90' of FIGS. 11C and 11D.

The illustration of FIG. 11D shows the completed product, with final folds 90' joining the partially bonded overlapped half panel assembly to the full width rear panel.

Figure 12:
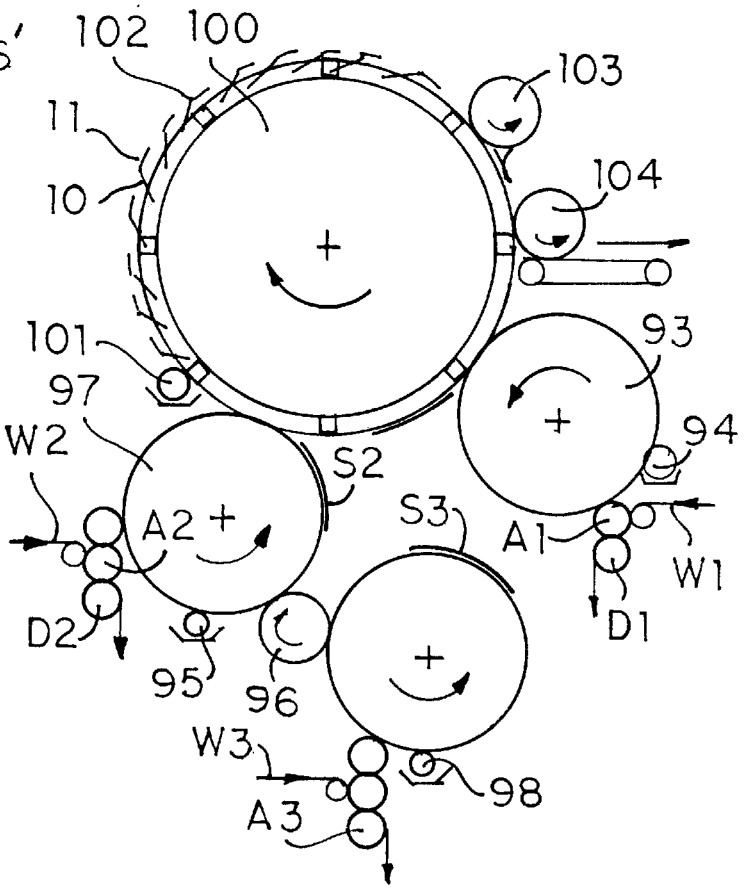
FIG. 12 is a side elevation of the apparatus for producing the pants illustrated in FIG. 12A.
Figure 12A:
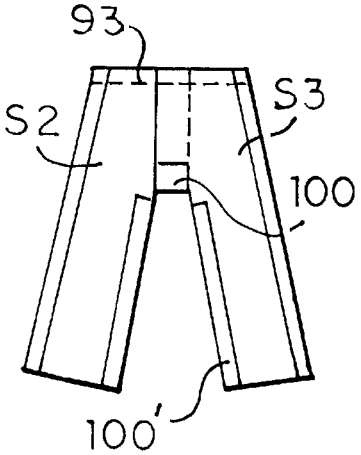
FIG. 12A is a front plan view of the pants made on the apparatus of FIG. 12 illustrating left and right segments and leg flap foldover.

FIG. 12 shows a machine for producing pants like FIG. 12A. A first full width web W1 is advanced through roll set D1, A1 to produce S1 with flaps along the legs and waistband. S1 is transferred to folding drum 93 and after adhesive is printed at roll 94, the waistband extensions are folded on drum 93 as at 93' of FIG. 12A.

Web W2 is advanced similarly through roll set D2, A2 to produce half width left hand segment S2 which has its top extension flap printed as at roll 95 and folded on drum 97 before it reaches position 96.

Similarly, web W3 passes through roll set D3, A3 to produce right hand segment S3, which is printed at roll 98, folded and seamed on drum 99 and via roll 96 transferred in centrally overlapped superposed relation to S2. Segments S2 and S3 are then transferred to drum 100 on top of segment S1 and are in registered superposition except for the leg flaps 100' of the underlying segment S1.

As the combined assembly on drum 100 passes roll 101, a pattern of adhesive is printed on the outer marginal surfaces of segments S2and S3. As the superposed segment assembly advances along the drum path, longitudinal folders like 10 and 11 of each folder assembly 102 fold flap extensions along selected margins of the pant legs over the pre-applied adhesive target areas.

Each of the folder assemblies 102 creates left or right hand folds, thus,a minimum of two assemblies are needed for very low speeds. Noting that the leg folds are at an acute angle to the machine direction (like e–e' or f–f' of FIG. 1), each assembly is mounted on a movable sub frame (not shown) that moves each folder assembly 102 transversely along a fixed non-rotating transverse axis.

In FIG. 12, a plurality of folding assemblies 102 is used for high speed production. Each assembly is operative on a first product with rod 10 and 11 lifting and folding side extensions (per FIG. 3 operations) and includes means (not shown) to pivot rods 10 and 11 to a position spaced outward from the circumference to thus become inoperative, and in a radial location, that avoids interference with product on the drum surface as the folding assemblies 102 are moved transversely.

When properly positioned for folding a pre-determined upstream product, rods 10 and 11 are pivoted back to the operative positions illustrated in FIGS. 2 and 3.

While leg folds are being completed by assemblies 102, the crotch flap shown centrally in FIG. 12 A can also be completed on drum 100 using finger type folding means 6 of FIG. 2 mounted to operate in a direction opposite the machine direction.

The completed product is transversely folded in half at roll 103 and transferred by roll 104 to downstream packaging.

FIG. 13 illustrates a sub assembly of rolls used to advance a short length of web into the nip between a slow speed cutting roll combination where a short rectangular segment is cut and transferred to a high speed roll couple that die cuts the segment to shape, separates the workpiece from the scrap, and transfers the workpiece to the product bearing surface of a drum for subsequent processing.

Figures 14, 14A:
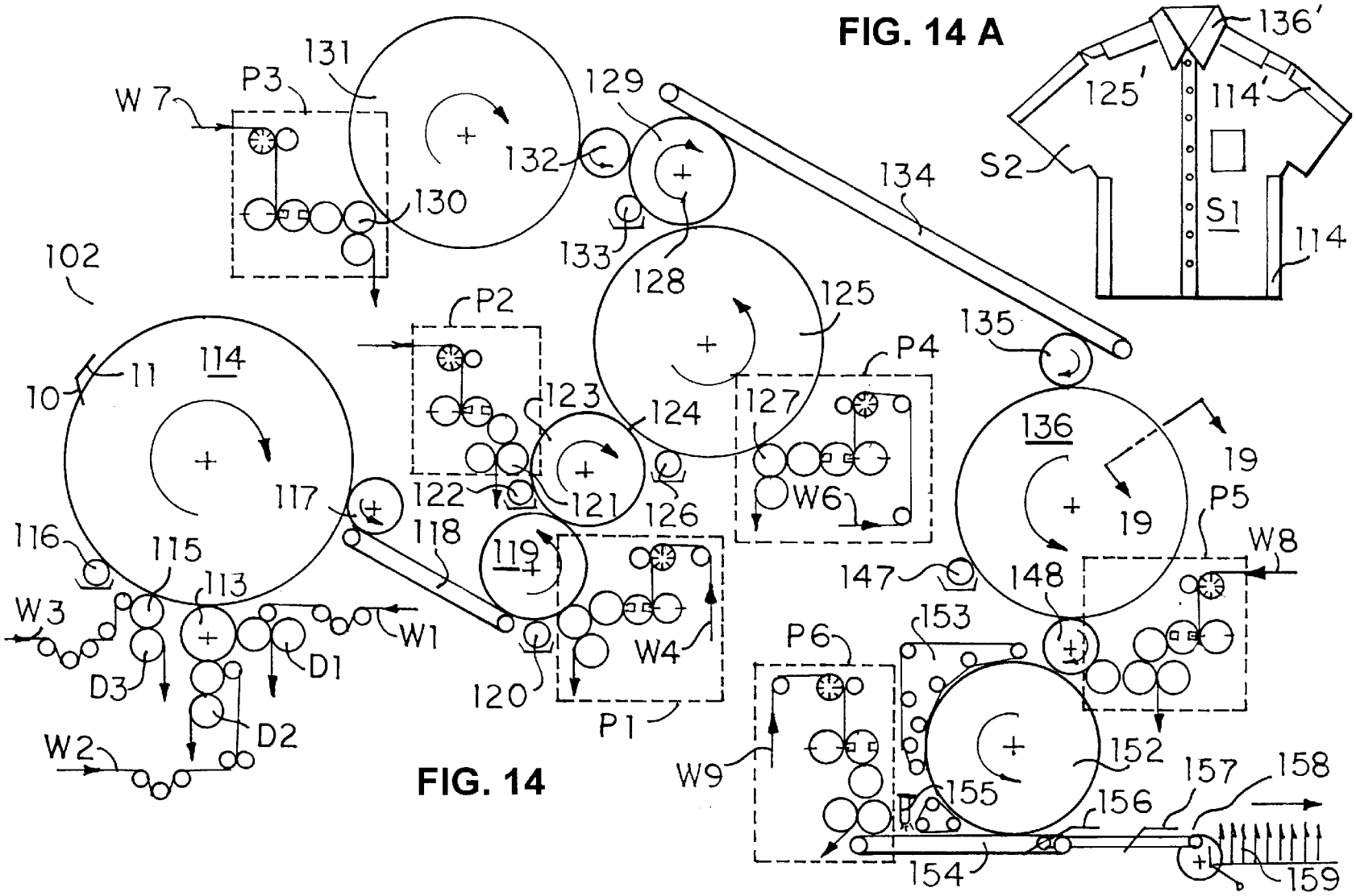
FIG. 14 is a side elevation schematic of the apparatus for producing the shirt illustrated in FIG. 14A.
FIG. 14A is a front plan view illustrating left and right half width segments connected to a full rear panel by folded flaps along shoulder and side margins.

The sub assembly of FIG. 13 is used for fabrication of special components, for example shoulder pieces and collars processed in the shirt machine of FIG. 14.

In FIG. 13, roll 105 and transversely slotted roll 106 meter a small repeat (length) segment for die cutting and advancement to roll 112 to combine with other panels etc.

For example, a 5" long reinforcing shoulder piece 125' of FIG. 15 would require 5" of web fed for every drum repeat (R of FIG. 2) for instance 40", thus rolls 105–108 have a speed ratio of 1:8 relative to the high speed roll couple 109–112. Roll 105 is vacuumized during rotation between 105 and the nip with roll 109. A low vacuum source communicates with M.D. slots in roll 109 so the leading edge of the next segment will be slideably urged forward as roll 109 rotates, and after cutoff by rolls 107, 108, the cut segment is free to rotate at the higher repeat speed of roll couple 109–112

High vacuum is applied to die roll 110 between and around the raised (cameo) cutting pattern and the coacting anvil roll 110'. Scrap pieces 111' is diverted downwardly using stripper fingers (not referenced) operating in grooves of roll 111 (see FIG. 13B). Workpiece 112' (FIG. 13C) is transferred to the bearing surface of a drum 1 for folding etc.

FIG. 13 sub assemblies for cutting and processing special workpieces are included in the shirt machine of FIG. 14, but detailed descriptions are not repeated for brevity.

In FIG. 14, the sub assemblies of FIG. 13 are enclosed by phantom lines and referred to as P1 through P6. Certain reference numbers are omitted for clarity, such as for anvil rolls and transfer rolls to the drum.

In FIG. 14, a first half width web is die cut in roll set D1 to produce segment S1 that is partially overlapped with, and superposed on, a second segment S2 which is die cut from web W2 in roll set D2. Segments S1 and S2 have flap extensions along shoulders and sides, and are transferred at position 113 to the vacuumized surface of drum 114. As the drum rotates, a third segment S3 cut from web W3 by roll set D3 is superposed on top of S1 and S2 at position 115. Segment S3 is shaped like the product outline with folded seams.

At print roll 116, a pattern of adhesive is applied in close proximity to selected margins of S3, and on further drum rotation, shoulder flaps and side extensions of segments S1, S2 are folded with devices of FIG. 2. At position 117, the now folded conjoined front/rear panel assembly with a front openable panel is transported by vacuumized belt 118 for transfer to drum 119.

A narrower web W4 is advanced through sub assembly P1 to fabricate unfolded pockets which are placed on an adhesive pattern applied by roll 120 to one of the front half panels.

In sub assembly P2, the shoulder piece of FIG. 15 is fabricated, advanced, and transferred at position 121 to the rear panel that faces outward and was previously printed with adhesive at print roll 122. Transfer roll 123 advances the shirt panels with attached shoulder piece and pockets for transfer at position 124 to drum 125 which folds the extended shoulder flaps over the outwardly facing front panel for bonding attachment to adhesive printed by roll 126.

Folds along the shoulders utilize the skewed finger mounting arrangement of FIG. 4. At position 127, a narrow strip pre-printed with decorative buttons is attached to the central area of the front panel closure and after shoulder folds are completed during rotation of drum 125, the assembly is transferred at position128 to transfer drum 129, and is printed with a pattern of adhesive for attachment of the collar being fabricated in sub assembly section P3.

The small segment sub assembly P3 fabricates and transports a cut collar shape like FIG. 16 and at position 130, transfers the unfolded collar to folding drum 131.

Means to apply adhesive to bond segments of the collar being folded on drum 131 are not shown, but are in contact with outwardly facing collar surface areas as drum 131 rotates between positions 130 and 132. Using the folding device and sequence of FIG. 2, a double transverse fold (including single folds of small side flaps on edges of the collar), produces a folded collar like FIG. 17 having 'soft' folded edges. The folded collar is transferred to be applied to the target pattern of adhesive printed at roll 133 and bonded to the rear panel of the shirt as it rotates on roll 129.

The shirt with the collar attached (see FIG. 18) is transported by vacuum belt 134 around transfer roll 135 and deposited on collar tri-folding drum 136.

In FIG. 18, the front panels of the shirt are omitted for clarity and phantom lines shows the lower triangular collar extension E attached to the rear surface of the back panel before the final triangular fold is begun. Phantom Pines starting at the tab ends on each side show the path of tab rotation and translation toward the center.

FIG. 19 illustrates the apparatus used to achieve the rotation shown in FIGS. 18 and 20 and movement of the assembly to overlap the tab ends in the center, as at 141'–142' of FIG. 19.

Figures 22, 22A, 22B, 22C, 22D, 22E, 22F:
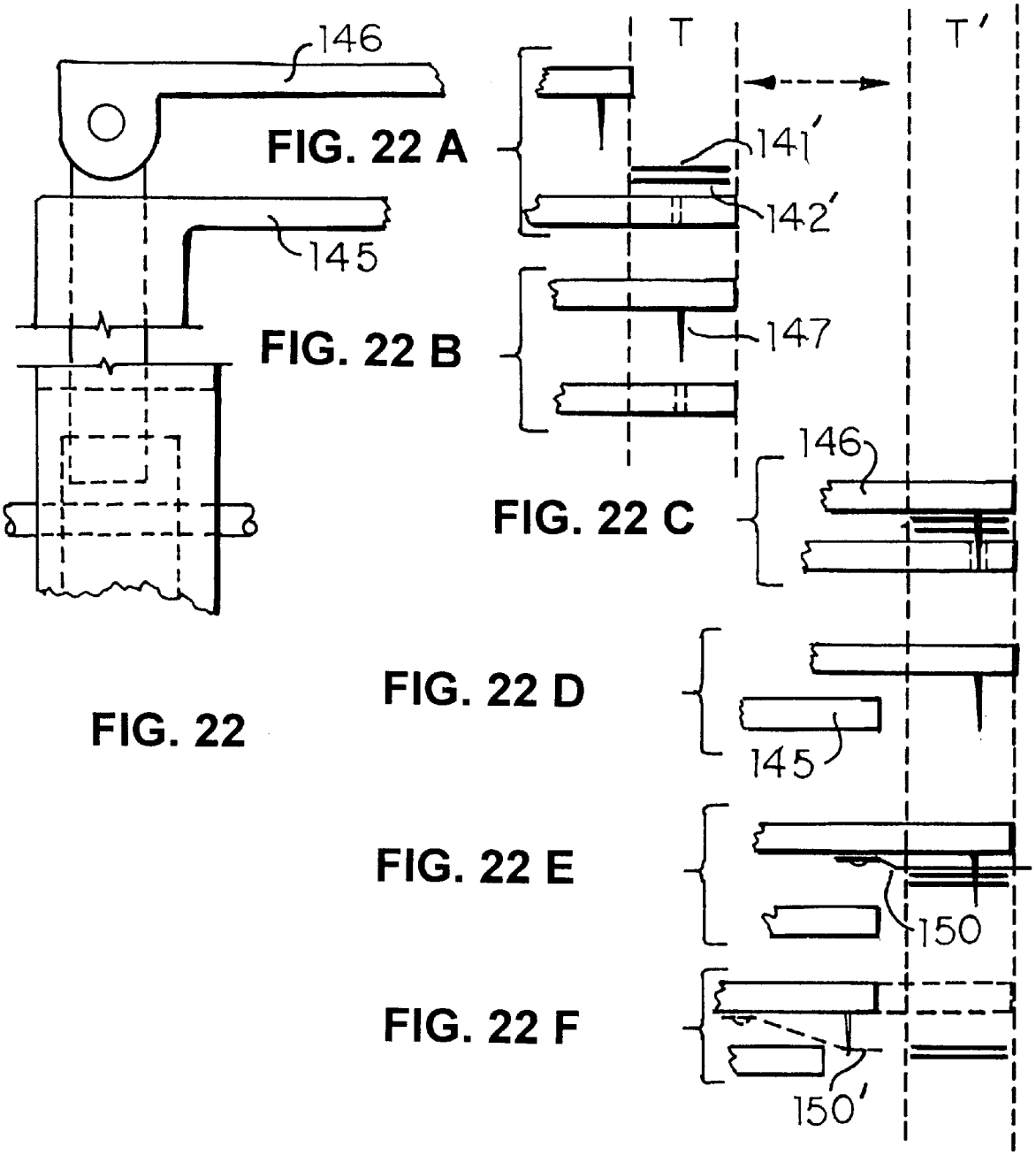
FIG. 22 is a side elevation schematic viewed from line 22—22 of FIG. 19 showing a somewhat diagrammatic sequence of the device used to complete the tri-fold FIG. 23.
FIG. 22A is a side elevation schematic illustrating operative elements of the pin mechanism before advancement to operating zone T.
FIG. 22B illustrates advancement of the top pin holding member to zone T in readiness for penetration through superposed collar tabs.

FIG. 22 shows the apparatus used to penetrate the overlapped tab ends with a pin 47 for movement and translation of the tab ends into the final tri-folded configuration of FIG. 23. The first of two phases for completion of the collar tri-fold is located in FIG. 19, and includes left hand vacuum gripper 137 being rotated about a shaft that has a vacuum manifold 139 communicating with an external vacuum source (not shown).

All elements for rotating the vacuum grippers and moving them toward the center of the machine for the overlapping function described above are of similar design but opposite handed. It is noted however, that the gripper ends 137 and 138 are of slightly different length.

When the shirt with attached collar is placed on drum 136, the assembly of FIG. 19 (located ahead of the collar and positioned in a cutout like 16 of FIG.3) completes the first of two folding phases. FIG. 19 is viewed opposite to machine direction and the folding drum shell is partially crosshatched to highlight cutouts under each vacuum gripper (see also FIG. 20—cutouts outside of phantom line not shown.

With different radii , vacuum grippers 137 and 138, after rotation to elevations 137' and 138', locate the tab ends at different spaced elevations so that movement of both tabs over the target area 144 can be achieved without interference between tabs.The lower tab is first placed on the slotted support plate 145, and the other tab is superposed on top.

When the tab ends are positioned on support plate 145 (see FIG. 22A), the pin arm 146 is rotated down for penetration of pin 147 through the two superposed tab ends 141' and 142'.

After the pin penetrates the tabs, pin arm 146 and arm supports are translated from a position T over target area 144 to a new remote position T'. The devices of FIG. 22 and the tri-folded results represent the second phase of the two phase folding sequence for the triangular folds shown in FIG. 23.

Before the triangular collar fold is completed, a pattern of adhesive is applied to margins along the V-neck opening, as at position 147 of FIG. 14.

In FIG. 19 various dovetail slide and lead screw arrangements provide for movement of the gripper assemblies toward and away from the center, up and down to move the assemblies below the surface when the folding cycle is complete in order to clear other co-acting rolls, and movement in both directions along the path of segment travel.

Actuators for the various motions are well known and not shown. In the device of FIG. 22, a spring biased stripper bar 150 (see FIG. 22D) urges the pin held tabs downward for stripping. Simultaneously, stationary rollers 151, 151" (shown phantom in FIG. 19) apply stripping and ironing pressure as the product rotates past.

The completed shirt is transported around roll 148 and placed on top of a previous wrapping segment being fabricated by sub assembly P5 from Web W8. Roll 148 can be relieved in the collar target area. Belt system 153 urges the completed shirt and collar against drum 152 while a segment of liner board from web W9 is severed by sub assembly P6 and advanced by belt 154 into superposed relationship with the shirt and the previous sheet against the drum.

A spray unit 155 applies a mist of adhesive on the folding board outside of the product outline, and by bonding contact with the previous sheet, thus enclosed the shirt. As the shirt/folding board/previous sheet combination advances along belt conveyor 154 bar folders 156 and 157 fold side panels inward in overlapping fashion. The now folded assemblage is transversely cross folded at 158 for delivery in magazine 159.

Viewed from the discharge end, the packaged shirt and collar is displayed above panels of the folding board which do not extend beyond the apex of the V-neck.

While in the foregoing specification specific embodiments are described, it is to be understood that the present invention may be embodied in other specific forms without departing from the spirit or special attributes, and it is, therefore, desired that the present embodiment be considered in all aspects as illustrative and therefore not restrictive, reference being made to the appended claim rather than to the foregoing description to indicate the scope of the invention.

Having thus described the invention, what is claimed as new and desired to protect by Letters Patent, are the following:

1. Apparatus for assembling shaped segments cut from web material to form garments with at least one openable panel including:

means to advance a first half width web and a narrower second web, means to print adhesive on both sides along one edge of said first web, means to V-fold said second web, means to bondably enclose said one edge of said first web within said V-folded second web to form a first web assembly, means to advance and die cut said first web assembly into a first segment having marginal extensions, means to advance and transfer said first segment to the bearing surface of a carrier drum moving in a path having a beginning and an end, means to advance a third half width web and a narrower fourth web, means to print adhesive on both sides along one edge of said third web, means to V-fold said fourth web, means to bondably enclose said one edge of said third web within said V-folded fourth web to form a second web assembly, means to advance and die cut said second web assembly into a second segment having marginal extensions, means to advance and transfer said second segment to the bearing surface of said carrier drum in partially overlapped superposed relationship to said first segment, means to advance a fifth full width web, die cut a third segment therefrom, and transfer said third segment to said carrier in superposed relationship with said first and second overlapped segments, assembly means on said carrier drum to;

apply a selected pattern of adhesive to marginal areas of said third segment, apply first positive and second positive force means to fold said marginal extensions of said first and second segments around and over the edges of said third segment, means to remove the assembled first, second, and third segments from said carrier drum as said drum approaches the end of said path.

2. The apparatus of claim 1 including means to combine the first and second web assemblies in overlapping relationship and advancing said combined assemblies through the same die cutting roll set, and transferring said overlapped segments to said carrier drum.

3. The apparatus of claim 1 including means to transfer said full width third segment to said carrier before said first and second overlapped segments are superposed thereon.

4. The apparatus of claim 1 wherein said means to V-fold said second and fourth webs is comprised of two spaced folding plates and includes a device to change the space between said plates while the webs are advancing.

5. The apparatus of claim 1 wherein said bearing surface of said carrier drum is defined by the outline shape of the finished product after marginal extensions are folded.

6. The apparatus of claim 5 wherein areas outside said bearing surface outline are at least partially removed.

7. The apparatus of claim 5 wherein said bearing surface outline of said carrier is bounded by at least two fold lines coincident with marginal edges of said outline shape.

8. The apparatus of claim 1 wherein cutouts in said bearing surface provide space for folding assembly means.

9. The apparatus of claim 8 wherein the surface of said carrier is circular and is continuous except for said cutouts.

10. The apparatus of claim 7 wherein surfaces of said carrier adjacet said cutouts support extensions of said first and second segments.

11. The apparatus of claim 1 including means to disengage said fifth web advancing means and including means to transverse fold the overlapped half width segments before marginal extensions of each segment are folded and bondably seamed.

12. The apparatus of claim 1 wherein said path includes said carrier drum as one of a series of carrier drums.

13. The apparatus of claim 12 wherein said advancing means includes vacuumized transport belts.

14. The apparatus of claim 1 wherein said V-folding means includes two plates mounted in spaced parallel relationship, each plate having one edge at 45 degrees from a line extension of the apex on the incoming web, and means to change the space between said plates while webs are being advanced.

15. The apparatus of claim 1 including devices to interrupt operation of folding assemblies that fold along lines substantially parallel to the machine direction, and means to restore operation while segments are being advanced.

16. The apparatus of claim 1 wherein said second and fourth web V-folding means are deactivated without affecting operation of said first and third web advancing means.

17. The apparatus of claim 1 wherein one of said corrier drums includes means to rotate and translate collar tab ends toward a centerline, and means to displace said tab ends a pre-determined distance in a direction opposite to the direction of the path to thereby define a triangular fold.

18. A method of fabricating articles of apparel having an openable and re-closeable front or rear panel including the steps of:

unwinding and advancing a first web having a width a few inches greater than one half of the product width and offsetting said first web from the machine centerline, printing adhesive on both sides along a marginal edge of said first web, unwinding and advancing a second narrower web in a direction perpendicular to the machine direction path, V-folding then inversely V-folding said second narrower web while concurrently orienting said second narrower web in the machine direction path, advancing said first web in the same direction as, and for enclosure by, said second web to form a first, web assembly, unwinding and advancing a third web having a width a few inches greater than one half of the product width, and offsetting said third web from the machine centerline in a direction opposite from said first web offset, printing adhesive on both sides of said third web along marginal edges, unwinding and advancing a fourth narrower web in a direction perpendicular to the machine direction path, V-folding then inversely V-folding said fourth narrower web while concurrently orienting said fourth web in the machine direction path, advancing said third web in the same direction as, and for enclosure by, said fourth web, to form a second web assembly, advancing said first web assembly through a die roll cutter and transferring said first segment to the vacuumized surface of said carrier, advancing said second web assembly through a die roll cutter and transferring a second segment in overlapped superposed relationship to said first segment, unwinding and advancing a fifth web through a die roll cutter to form a full width third segment, transferring the full width third segment in superposed relationship with said overlapped first and second segments on said carrier, printing an adhesive pattern along the margins of said third segment, folding extended portions of said first and second segments of a front panel over said third segment of a rear panel to form a conjoined assembly, advancing the conjoined assembly along said machine direction path, applying closure means between said front panel segments, removing said conjoined assembly from said machine direction path.

19. The method of claim 18 wherein said closure means are applied separately along selected margins of said first and second webs before said webs are cut into said first and second segments.

* * * * *